US008588665B2

(12) United States Patent
Endo et al.

(10) Patent No.: US 8,588,665 B2
(45) Date of Patent: Nov. 19, 2013

(54) TONER CARRIER, DEVELOPING DEVICE AND IMAGE FORMING APPARATUS

(75) Inventors: Hiroyuki Endo, Sagamihara (JP); Kazuhiro Kotaka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 271 days.

(21) Appl. No.: 13/051,352

(22) Filed: Mar. 18, 2011

(65) Prior Publication Data

US 2011/0229217 A1 Sep. 22, 2011

(30) Foreign Application Priority Data

Mar. 18, 2010 (JP) ..... 2010-062688

(51) Int. Cl.
*G03G 15/08* (2006.01)
*G03G 15/09* (2006.01)

(52) U.S. Cl.
USPC ..... 399/286; 399/266; 399/291

(58) Field of Classification Search
USPC ..... 399/286, 279, 266, 265, 291; 492/35, 492/43, 44; 29/895
See application file for complete search history.

(56) References Cited

U.S. PATENT DOCUMENTS 4,289,837 A * 9/1981 Gundlach ..... 430/39
4,318,606 A * 3/1982 Buholtz et al. ..... 399/276
6,196,958 B1 * 3/2001 Shiraki et al. ..... 492/35 X
6,708,014 B2 3/2004 Miyaguchi et al.
2007/0086811 A1 4/2007 Tsukamoto et al.
2008/0286015 A1 * 11/2008 Kadota et al. ..... 399/266
2010/0021214 A1 * 1/2010 Kadota et al. ..... 399/266

FOREIGN PATENT DOCUMENTS

JP 09-319211 A * 12/1997
JP 2002-341656 11/2002
JP 2003-255692 9/2003
JP 2004-191835 7/2004
JP 2005-952 1/2005
JP 2007-86091 4/2007
JP 2007-133376 5/2007
JP 2009-204632 A * 9/2009

* cited by examiner

*Primary Examiner* — Sophia S Chen
(74) *Attorney, Agent, or Firm* — Cooper & Dunham LLP

(57) ABSTRACT

An image forming apparatus includes a developing device. The developing device includes a toner carrier (developing roller). The developing roller includes a base member, electrode bars, a pair of electrodes, and a protection layer. The base member includes a conductive core and an insulating layer formed on the outer surface of the core. The electrode bars and the pair of electrodes are made of a conductive metal, and are provided on the outer surface of the insulating layer. The electrode bars and the pair of electrodes are formed in a way that an unnecessary portion of a metal film is irradiated with a laser beam and thus is removed. The electrodes are each formed helically on the outer surface of the base member 1 and formed to taper down toward the outmost side thereof in its cross section.

10 Claims, 9 Drawing Sheets

TONER CARRIER, DEVELOPING DEVICE AND IMAGE FORMING APPARATUS

CROSS-REFERENCE TO THE RELATED APPLICATION

This application is based on and claims the priority benefit of Japanese Patent Application No. 2010-062688, filed on Mar. 18, 2010, the contents of which are incorporated herein by reference.

BACKGROUND OF THE INVENTION

1. Field of the Invention

The present invention relates to a toner carrier such as a developing roller, a developing device and an image forming apparatus which are used in a copy machine, a facsimile, a printer or the like. More specifically, the present invention relates to a toner carrier and a developing device configured to form a toner image on a latent image carrier by conveying toner particles hopping on an outer circumferential surface thereof to a development region facing the latent image carrier and then by developing an electrostatic latent image on the latent image carrier. Moreover, the present invention relates to an image forming apparatus including the developing device.

2. Description of the Related Art

As a conventional developing device provided in an image forming apparatus, there is known a developing device configured to develop an electrostatic latent image by using toner particles hopping on the outer circumferential surface of a toner carrier such as a developing roller (for example, see Japanese Patent Application Publication No. 2003-255692 (called Patent Document 1 below)). The developing roller as the toner carrier in the developing device disclosed in Patent Document 1 includes a cylindrical member and a pair of conductive electrode bars. The cylindrical member is made of an acrylic resin and is provided with first electrodes and second electrodes which are arranged alternately in a circumferential direction and are electrically isolated from each other. The electrode bars are respectively attached to both end portions of the cylindrical member in a longitudinal direction thereof and are each electrically connected to the first electrodes or the second electrodes.

The electrodes are formed in the following manner. Firstly, in a cutting process, grooves each extending in the longitudinal direction of the cylindrical member are formed in the outer circumferential surface of the cylindrical member. After that, a plating layer is formed on the entire outer circumferential surface of the cylindrical member by electroless nickel plating. Then portions of the plating layer on the outer circumferential surface except inside the grooves are removed in another cutting process. Thereby, the electrodes are formed inside the grooves, respectively. The outer circumferential surface of the cylindrical member including surfaces of the electrodes is entirely coated with a silicone resin.

In the developing roller thus manufactured, an AC power source applies an AC voltage to a pair of electrodes, that is, the first electrode and the second electrode. In the developing roller, an alternating electric field is formed between the first electrode and the second electrode, and thereby causes toner particles to be hopping so as to repeatedly reciprocate between the first electrode and the second electrodes. To be more specific, the developing roller causes toner particles placed above the first electrode to float up and land on the second electrode and then to float up again from the second electrode and land on the first electrode. The developing roller is rotated about its axial center and thereby conveys the toner particles to the development region facing the latent image carrier. The developing roller develops an electrostatic latent image on the latent image carrier by causing the hopping toner to be adsorbed by the electrostatic latent image in the development region.

As described above, the developing roller described in Patent Document 1 develops the electrostatic latent image not by using toner particles adhering to the outer circumferential surface of the developing roller or magnetic carriers, but by using toner particles not exerting the adsorptive power due to the hopping. In this way, the developing roller is capable of performing a low voltage development by causing toner particles to be adsorbed by a portion of the outer circumferential surface of the latent image carrier holding an electrostatic latent image whose potential difference from a non-image portion is only several tens volts.

The developing roller described in Patent Document 1, however, needs the cutting processes for forming the foregoing grooves and for removing the unnecessary portions of the plating layer, and thereby tends to raise a cost with an increase in time required for the processes. In addition, chips generated in the cutting processes may short-circuit the electrodes, or the developing roller may fail to achieve desired accuracy due to the cylindrical member deformed in the cutting process for forming the grooves.

To solve the problems of the developing roller described in Patent Document 1, the applicants of the present invention have proposed a developing roller in which the first electrode and the second electrode are each formed by helically winding a metal foil having a width of approximately 30 μm around the outer circumferential surface of a cylindrical member (for example, see Japanese Patent Application Publication No. 2004-191835 (called Patent Document 2 below) and Japanese Patent Application Publication No. 2007-86091).

In the above developing roller described in Patent Document 2, however, the metal foils are wound helically, and hence gaps tend to be formed between the wound metal foils and the cylindrical member. The formation of gaps makes it difficult to manufacture the electrodes with desired accuracy (in other words, makes it difficult to form the electrodes exactly in desired positions).

Further, as described above, the gaps are formed between the wound metal foils and the cylindrical member because the electrodes are formed by winging the metal foils helically. With aging degradation, the gaps allow the metal foils, that is, the electrodes to get out of position on the cylindrical member or cause a problem in durability of the electrodes.

SUMMARY OF THE INVENTION

It is an objective of the present invention is to provide a toner carrier having an outer circumferential surface provided with electrodes with improved durability, a developing device and an image forming apparatus.

In order to achieve the above objective, a toner carrier according to an embodiment of the present invention is configured to convey hopping toner particles to a development region facing a latent image carrier, and at least includes: a base member including an insulating layer made of an insulator on an outer surface of the base member; and at least one ribbon-shaped electrode helically formed on the outer surface of the base member. The electrode is formed in a manner that both sides of the electrode 3 are inclined so that the electrode 3 gradually tapers down from a base member side toward an outmost side thereof, and is formed to be flat in a center portion in a width direction of the electrode so that an outer surface of the center portion is in parallel with the outer surface of the base member.

DETAILED DESCRIPTION OF THE PREFERRED EMBODIMENTS

Preferred embodiments of the present invention will be described in detail hereinafter with reference to the accompanying drawings.

Figure 1:
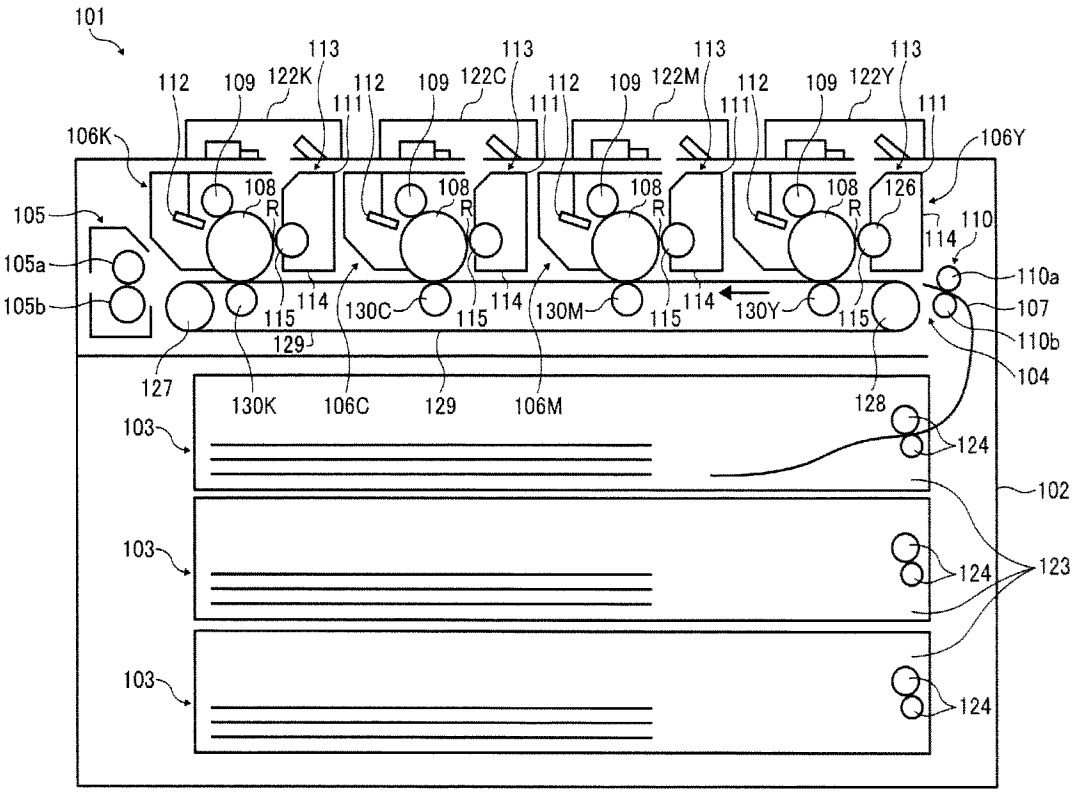
FIG. 1 is an explanatory diagram showing a configuration of an image forming apparatus including a developing roller according to a first embodiment of the present invention, when viewed from the front side.

FIG. 1 illustrates an image forming apparatus according to the present invention. The image forming apparatus 101 is configured to form images of colors of yellow (Y), magenta (M), cyan (C) and black (K), in short, a color image on a recording sheet 107 (shown in FIG. 1) as a transfer material. Note that, units and other components for the respective colors of yellow, magenta, cyan and black will be denoted below with Y, M, C, K attached to the ends of their reference numerals, respectively.

As shown in FIG. 1, the image forming apparatus 101 at least includes an apparatus main body 102, sheet feeder units 103, a resist roller pair 110, a transfer unit 104, a fixation unit 105, plural laser write units 122Y, 122M, 122C, 122K, and plural process cartridges 106Y, 106M, 106C, 106K.

The apparatus main body 102 is formed in a box shape, for example, and is installed on a floor or the like. The apparatus main body 102 houses therein the sheet feeder units 103, the resist roller pair 110, the transfer unit 104, the fixation unit 105, the plural laser write units 122Y, 122M, 122C, 122K, and the plural process cartridges 106Y, 106M, 106C, 106K.

The sheet feeder units 103 are provided in plurality in a lower portion of the apparatus main body 102. The sheet feeder units 103 each include a sheet feeder cassette 123 to store therein the aforementioned recording sheets 107 in a stacked manner, and a sheet feeder roller 124. The sheet feeder cassette 123 can be freely taken in and out of the apparatus main body 102. The sheet feeder roller 124 is pressed against the top recording sheet 107 in the sheet feeder cassette 123. The sheet feeder roller 124 sends the top recording sheet 107 to an interstice between a conveyance belt 129 of the transfer unit 104 and a photosensitive drum 108 of a developing device 113 in each of the process cartridges 106Y, 106M, 106C, 106K. The conveyance belt 129 and also the photosensitive drum 108 will be later described in detail.

The resist roller pair 110 is provided in a conveyance route of the recording sheet 107 conveyed from the sheet feeder unit 103 to the transfer unit 104 and includes a pair of rollers 110*a*, 110*b*. The resist roller pair 110 holds the recording sheet 107 between the pair of rollers 110*a*, 110*b* and sends the held recording sheet 107 to an interstice between the transfer unit 104 and the process cartridges 106Y, 106M, 106C, 106K at such a timing that toner images can be exactly overlaid on the recoding sheet 107.

The transfer unit 104 is provided above the sheet feeder units 103. The transfer unit 104 includes a driving roller 127, a driven roller 128, the conveyance belt 129, and transfer rollers 130Y, 130M, 130C, 130K. The driving roller 127 is arranged on a downstream side in a conveyance direction of the recording sheet 107, and is driven to rotate by a drive source such as a motor.

The driven roller 128 is rotatably supported by the apparatus main body 102, and is arranged on an upstream side in the conveyance direction of the recording sheet 107. The conveyance belt 129 is formed in an endless annular shape, and is wound around both the aforementioned driving roller 127 and driven roller 128. When the driving roller 127 is driven to rotate, the conveyance belt 129 rotates (runs in an endless manner) around the foregoing driving roller 127 and driven roller 128 in a counterclockwise direction in FIG. 1.

The transfer rollers 130Y, 130M, 130C, 130K and the respective photosensitive drums 108 of the process cartridges 106Y, 106M, 106C, 106K sandwich the conveyance belt 129 and the recording sheet 107 conveyed on the conveyance belt 129. In the transfer unit 104, the transfer rollers 130Y, 130M, 130C, 130K press the recording sheet 107 sent from the sheet feeder unit 103 against the outer surfaces of the photosensitive drums 108 of the process cartridges 106Y, 106M, 106C, 106K, respectively, thereby to transfer toner images on the photosensitive drums 108 onto the recording sheet 107. Then, the transfer unit 104 conveys the recording sheet 107 having the toner images transferred thereon toward the fixation unit 105.

The fixation unit 105 is provided downstream of the transfer unit 104 in the conveyance direction of the recording sheet 107 and includes a pair of rollers 105*a*, 105*b* between which the recording sheet 107 is to be held. The fixation unit 105 presses and heats the recording sheet 107 sent from the transfer unit 104 while holding the recording sheet 107 between the pair of rollers 105*a*, 105*b* and thereby fixes the toner images, transferred from the photosensitive drums 108 onto the recording sheet 107, to the recording sheet 107.

The laser write units 122Y, 122M, 122C, 122K are attached to an upper portion of the apparatus main body 102. The laser write units 122Y, 122M, 122C, 122K correspond to the respective process cartridges 106Y, 106M, 106C, 106K. The laser write units 122Y, 122M, 122C, 122K apply laser beams to the outer surfaces of the photosensitive drums 108 uniformly charged by later-described charge rollers 109 of the respective process cartridges 106Y, 106M, 106C, 106K, and thereby form the electrostatic latent images on the photosensitive drums 108.

The process cartridges 106Y, 106M, 106C, 106K are provided between the transfer unit 104 and the respective laser write units 122Y, 122M, 122C, 122K. The process cartridges 106Y, 106M, 106C, 106K are detachably attachable to the apparatus main body 102. The process cartridges 106Y, 106M, 106C, 106K are arranged side by side with each other in the conveyance direction of the recording sheet 107.

As shown in FIG. 1, each of the process cartridges 106Y, 106M, 106C, 106K includes a cartridge case 111, the charge roller 109 as a charge device, the photosensitive drum (equivalent to the latent image carrier) 108, a cleaning blade 112 as a cleaning device, and the developing device 113. Hence, the image forming apparatus 101 at least includes the charge rollers 109, the photosensitive drums 108, the cleaning blades 112, and the developing devices 113.

The cartridge case 111 is detachably attachable to the apparatus main body 102, and houses therein the charge roller 109, the photosensitive drum 108, the cleaning blade 112, and the developing device 113. The charge roller 109 uniformly charges the outer surface of the photosensitive drum 108. The photosensitive drum 108 is arranged at a distance from a later-described developing roller 115 of the developing device 113.

The photosensitive drum 108 is formed in a solid or hollow columnar shape to be rotatable about its axis center. The photosensitive drum 108 has an electrostatic latent image formed on its own outer surface by a corresponding one of the laser write units 122Y, 122M, 122C, 122K. The photosensitive drum 108 develops the electrostatic latent image formed and carried on the outer surface thereof by attracting toner particles T to the electrostatic latent image (shown in FIG. 3). The photosensitive drum 108 transfers the thus obtained toner image to the recording sheet 107 positioned between the photosensitive drum 108 and the conveyance belt 129. After the toner image is transferred to the recording sheet 107, the cleaning blade 112 removes the residual toner particles after transfer remaining on the outer surface of the photosensitive drum 108.

As shown in FIG. 1, the developing device 113 at least includes a developer supply unit 114, and the developing roller 115 as a toner carrier.

The developer supply unit 114 contains a developer therein. The developer includes toner particles T and magnetic carriers (also called magnetic powder). The toner particles T are fine circular particles manufactured in an emulsion polymerization method or suspension polymerization method. Here, the toner particles T may be obtained by grinding a block of synthetic resin in which various dyes or pigments are mixed and dispersed. An average particle diameter of the toner particles T is 3 μm to 7 μm, both inclusive. Meanwhile, the magnetic carriers may be formed in a grinding process or another similar process. An average particle diameter of the magnetic carriers is 20 μm to 50 μm, both inclusive. The developer supply unit 114 supplies the toner particles T and the magnetic carriers, i.e., the developer to the outer surface of the developing roller 115 while agitating the toner particles T and the magnetic carriers.

The developing roller 115 is formed in an approximately columnar shape, is provided between the developer supply unit 114 and the photosensitive drum 108, and is driven to rotate about its axial center by an unillustrated drive source. The axial center of the developing roller 115 is in parallel with the axial center of the photosensitive drum 108. The developing roller 115 is arranged at a distance from the photosensitive drum 108. A space between the developing roller 115 and the photosensitive drum 108 forms a development region R where a toner image can be obtained by developing the electrostatic latent image with the toner particles T in the developer adsorbed by the photosensitive drum 108. In the development region R, the developing roller 115 and the photosensitive drum 108 face each other.

Figure 2:
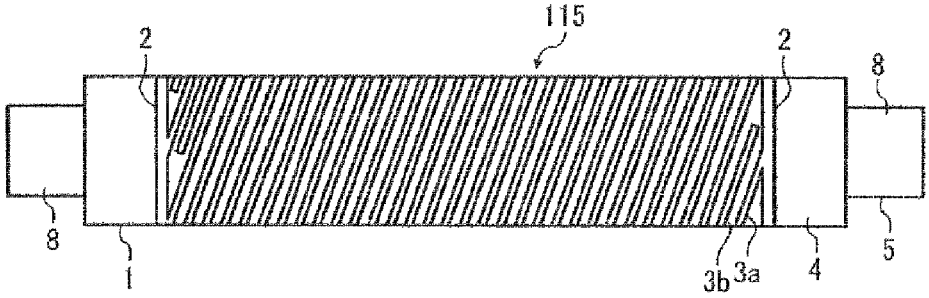
FIG. 2 is a side view of a developing roller of the image forming apparatus shown in FIG. 1.
Figure 3:
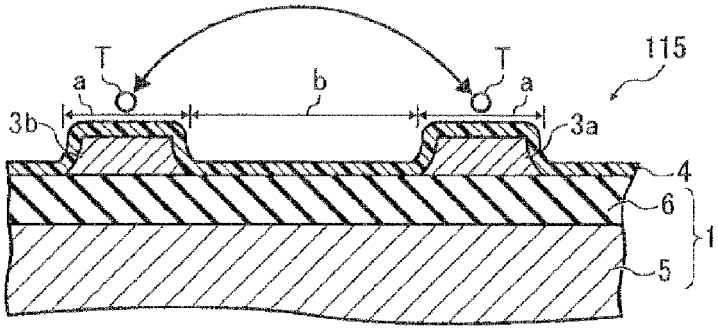
FIG. 3 is a cross sectional view of an essential portion of the developing roller shown in FIG. 2.

As shown in FIGS. 2 and 3, the developing roller 115 includes a base member 1 in a columnar shape, a pair of electrode bars 2 (shown only in FIG. 2) formed on an outer surface of the base member 1, at least a pair of electrodes 3*a*, 3*b* (equivalent to at least one electrode), and a protection layer 4 (shown only in FIG. 3).

Figure 5:
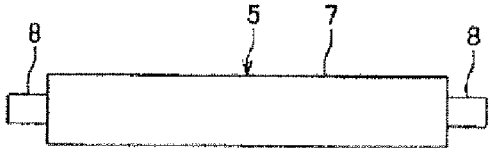
FIG. 5 is a side view of a core in the developing roller shown in FIG. 2.

As shown in FIG. 2, the base member 1 includes a core 5 as a base metal made of a conductive metal such as an aluminum alloy, and an insulating layer 6 formed with a uniform thickness on an entire outer surface of a large-diameter portion 7 of the core 5. The core 5 integrally includes the large-diameter portion 7 in a columnar shape and a pair of small-diameter portions 8 provided concentrically with the large-diameter portion 7 and formed in columnar shapes respectively protruding from both end surfaces of the large-diameter portion 7, as shown in FIG. 5. The large-diameter portion 7 and the small-diameter portions 8 are each formed to have an external diameter uniform in the axial center direction thereof. As a matter of course, the large-diameter portion 7 is formed to have a larger external diameter than the small-diameter portions 8. The insulating layer 6 is made of a synthetic resin having insulating properties. Thus, the outer surface of the base member 1 is provided with the insulating layer 6 made of an insulator. Here, the outer surface of the insulating layer 6 serves as the outer surface of the base member 1.

Figure 4:
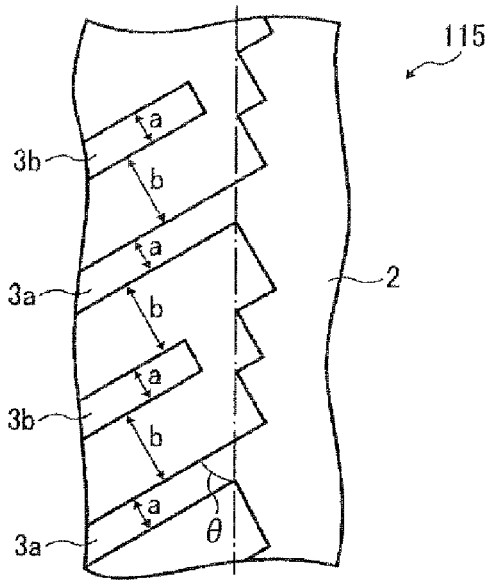
FIG. 4 is a planar view showing an enlarged view of an essential portion of the developing roller shown in FIG. 2.

The electrode bars 2 and the electrodes 3*a*, 3*b* are made of a conductive metal. The electrode bars 2 and the electrodes 3*a*, 3*b* are formed of the same metal with the same thickness. The pair of electrode bars 2 are formed on both end portions, in the axial center direction, of the outer surface of the insulating layer 6 of the base member 1. Each of the electrode bars 2 is formed entirely around the corresponding end portion of the outer surface of the insulating layer 6 of the base member 1 while extending in a direction orthogonal to the axial center. In addition, edge portions of the respective paired electrode bars 2 that are adjacent to each other are each formed in a saw-teeth shape as shown in FIG. 4.

The pair of electrodes 3*a*, 3*b* are ribbon-shaped and are arranged in parallel at a distance from each other between the electrode bars 2 on the outer surface of the insulating layer 6 of the base member 1. Each of the pair of electrodes 3*a*, 3*b* is formed in a helical shape on the outer surface of the insulating layer 6 of the base member 1. In other words, each of the pair of electrodes 3*a*, 3*b* is formed to have a longitudinal axis inclined to the axial center of the base member 1 and is formed over its entire length to be uniformly tilt at an inclination θ (shown in FIG. 4) with respect to the electrode bars 2. Moreover, of the pair of electrodes 3*a*, 3*b*, the electrode 3*a* is continuous with one of the electrode bars 2 and thus is connected to the one electrode bar 2, while being away from the other electrode bar 2 and thus is electrically isolated from the other electrode bar 2. Of the pair of electrodes 3*a*, 3*b*, the other electrode 3*b* is continuous with the other electrode bar 2 and thus is connected to the other electrode bar 2, while being away from the one electrode bar 2 and thus is electrically isolated from the one electrode bar 2.

Additionally, each of the electrodes 3*a*, 3*b* is formed to have a cross section in which both sides of the electrode 3*a* or 3*b* are inclined so that the electrode 3*a* or 3*b* can gradually taper down from the base member 1 side toward the outmost side thereof. Further, each of the electrodes 3*a*, 3*b* is formed to be flat at a center portion in a width direction thereof so that the outer surface of the center portion can be in parallel with the outer surface of the insulating layer 6 of the base member 1 in its cross section, as shown in FIG. 3.

The protection layer 4 is made of an insulating synthetic resin, and covers the entire surfaces of the electrode bars 2, the electrodes 3*a*, 3*b* and the insulating layer 6.

In the developing roller 115 having the foregoing configuration, an AV voltage is applied to the pair of electrodes 3*a*, 3*b* through the electrode bars 2, and thereby the pair of electrodes 3*a*, 3*b* form an alternating electric field in between. Thus, the developing roller 115 causes the toner particles T to be hopping so as to repeatedly reciprocate between the electrodes 3*a*, 3*b* adjacent to each other. In this way, the developing roller 115 adsorbs the developer supplied from the developer supply unit 114, and causes the toner particles T to be hopping on the outer circumferential surface thereof. Then, while being driven to rotate about the axial center between the photosensitive drum 108 and the developer supply unit 114, the developing roller 115 develops the electrostatic latent image on the photosensitive drum 108 by causing the toner particles T hopping on the outer circumferential surface thereof to be adsorbed by the electrostatic latent image.

Figure 6:
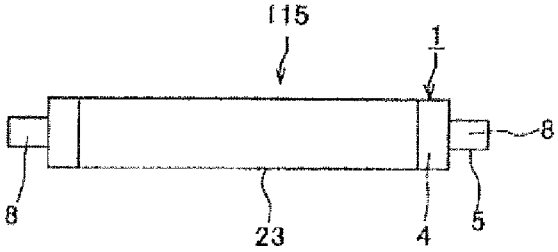
FIG. 6 is a side view of the core shown in FIG. 5 after an insulating layer is formed on the core and further a metal film is formed uniformly on the insulting layer.

The developing roller 115 having the foregoing configuration is manufactured in the following way. Firstly, the core 5 shown in FIG. 5 is formed integrally as a single unit by using the aforementioned metal such as an aluminum alloy. Then, the insulating layer 6 made of an insulating synthetic resin with a uniform thickness is formed on the entire outer surface of the large-diameter portion 7 of the core 5. Thereafter, as shown in FIG. 6, a metal film 23 made of the foregoing metal for forming the electrode bars 2 and the electrodes 3*a*, 3*b* is uniformly formed on the entire outer surface of the insulating layer 6. After that, an unnecessary portion of the metal film 23 other than the electrodes 3*a*, 3*b* and the electrode bars 2 is removed by a surface machining apparatus 30 shown in FIG. 7. Then, the resultant insulating layer 6 and others are coated with the protection layer 4.

Figure 7:
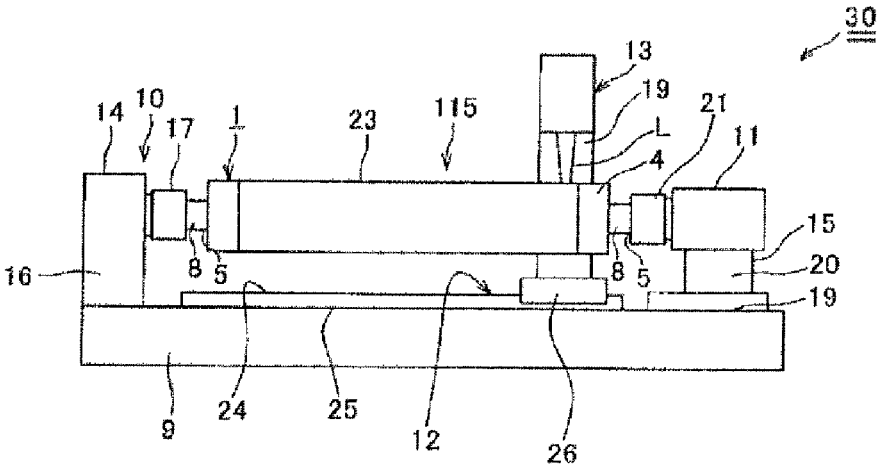
FIG. 7 is a side view of a schematic configuration of a surface machining apparatus for performing machining of the metal film on the developing roller shown in FIG. 6.

As shown in FIG. 7, the surface machining apparatus 30 includes a base 9, a holder unit 10, a motor 11 as a rotation drive unit, a tool movement unit 12 as movement means tool, a laser irradiator 13, and an unillustrated control device.

The base 9 is formed in a flat-plate shape and is installed on a floor, table or the like in a plant. The top surface of the base is placed in parallel with the horizontal direction. The base 9 is formed to have a rectangular planar shape.

The holder unit 10 includes a fixed holder portion 14 and a sliding holder portion 15. The fixed holder portion 14 includes a fixed pole 16 provided to extend vertically upward from an longitudinal end portion of the base 9, and a rotation chuck 17 provided to an upper end portion of the fixed pole 16. The rotation chuck 17 is formed in a thick circular plate shape and is supported by the upper end portion of the fixed pole 16 to be rotatable about its own center. The rotation center of the rotation chuck 17 is placed in parallel with the surface of the base 9.

The sliding holder portion 15 includes a slider 19, a slide pole 20, and a rotation chuck 21 provided to an upper end portion of the slide pole 20. The slider 19 is provided to be slidable along the surface of the base 9, that is, along the axial center of the rotation chuck 17. In addition, the slider 19 is configured so that the position of the rotation chuck 21 in the axial center direction can be fixed appropriately as needed.

The slide pole 20 is provided to extend vertically upward from the slider 19. The rotation chuck 21 is formed in a thick circular plate shape and is attached to an output shaft of a motor 11 attached to the upper end portion of the slide pole 20. The rotation center of the rotation chuck 21 is placed coaxially with that of the rotation chuck 17 of the fixed holder portion 14.

The above holder unit 10 holds the developing roller 115 as follows. Firstly, the developing roller 115 already having the metal film 23 uniformly formed but yet to be removed at the unnecessary potion is positioned between the rotation chucks 17, 21 with the sliding holder portion 15 separated from the fixed holder portion 14. After that, in the holder unit 10, the small-diameter portions on both end sides of the developing roller 115 are positioned inside the rotation chucks 17, 21 while the sliding holder portion 15 is moving toward the fixed holder portion 14, and then the slider 19 is fixed with the developing roller 115 held between the rotation chucks 17, 21. In this way, the holder unit 10 holds the developing roller 115 between the rotation chucks 17, 21.

The motor 11 is attached to the upper end portion of the slide pole 20 of the sliding holder portion 15. The motor 11 drives and rotates the rotation chuck 21 about its center. The motor 11 rotates the developing roller 115 held between the rotation chucks 17, 21 by driving and rotating the rotation chuck 21.

The tool movement unit 12 includes a linear guide 24 and an unillustrated movement actuator. The linear guide 24 includes a rail 25 and a slider 26. The rail 25 is placed on the base 9. The rail 25 is formed in a straight line shape and is arranged so that a longitudinal direction of the rail 25 can be in parallel with a longitudinal direction of the base 9, i.e., the axial center of the developing roller 115 held between the rotation chucks 17, 21. The slider 26 is supported on the rail 25 to be movable in the longitudinal direction of the rail 25. The movement actuator is mounted on the base 9 and slides the slider 26 in the longitudinal direction of the base 9, i.e., along the axial center of the developing roller 115 held between the rotation chucks 17, 21.

The laser irradiator 13 is attached to a tool main body having a pole shape and extending upward from the slider 26. The laser irradiator 13 applies a laser beam L as a high energy beam to the metal film 23 uniformly formed on the outer surface of the insulating layer 6 of the base member 1 in the developing roller 115 held between the rotation chucks 17, 21. In addition, the circumferential direction of the laser irradiator 13 about the axial center is changed appropriately as needed by an unillustrated rotation drive source attached to the tool main body.

Figure 9:
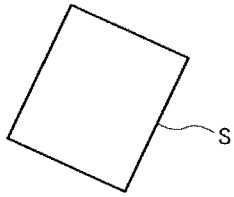
FIG. 9 is an explanatory view showing a shape of a spot of a laser beam of the surface machining apparatus shown in FIG. 7.
Figure 10:
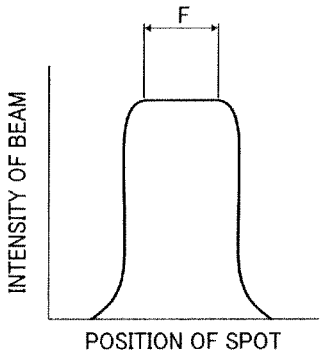
FIG. 10 is an explanatory view showing an intensity distribution of a laser beam of the surface machining apparatus shown in FIG. 7.

The laser irradiator 13 includes a laser oscillator configured to emit the laser beam L, and a beam shaping system configured to shape the laser beam L emitted by the laser oscillator so that the laser beam L on the outer surface is applied to a spot S (shown in FIG. 9) in a rectangular shape and have an intensity distribution in an approximately rectangular shape shown in FIG. 10. The beam shaping system includes two paired cylindrical lenses being curved orthogonal to each other and having the cylindrical surfaces facing the laser oscillator. The two paired cylindrical lenses are arranged in an optical axis direction of the laser beam L. The laser irradiator 13 sublimes the metal forming the metal film 23 by irradiating the metal film 23 with the laser beam L, and removes the metal film 23 in a portion irradiated with the laser beam L. In this way, the laser irradiator 13 removes the unnecessary portion other than the electrode bars 2 and the electrodes 3*a*, 3*b* from the metal film 23.

The control device is a computer including a well known RAM, ROM, CPU and other components. The control device is connected to the motor 11 as the rotation drive unit, the movement actuator of the tool movement unit 12, the foregoing rotation drive source, the laser irradiator 13 and the like, and takes control of the entire surface machining apparatus 30 by controlling these units.

In order to remove the unnecessary portion from the metal film 23 and to leave only the electrode bars 2 and the electrodes 3*a*, 3*b* on the outer surface of the insulating layer 6 of the base member 1, the control device causes the rotation drive source to set the direction of the laser irradiator 13 about the axial center to be a predetermined direction. Here, let θ (degree, shown in FIG. 4) be an inclination of an outer edge of the spot S on the insulating layer 6 of the base member 1 with respect to the direction orthogonal to the axial center of the developing roller 115 (the longitudinal direction of the electrode bars 2). Then, the direction about the axial center here set can be expressed in following Formula 1:

$$\theta=\sin^{-1}(m\times(a+b)/2\pi r) \qquad \text{Formula 1,}$$

where a denotes a width of each of the electrodes 3*a*, 3*b*; b denotes a width of a space between the electrodes 3*a*, 3*b*; r denotes a radius of the developing roller 115; and m denotes the number of portions of the electrodes 3*a*, 3*b* arranged in the axial center direction of the developing roller 115.

For the direction setting, the control device figures out the above-mentioned inclination θ (degree) from the width a of the electrodes 3*a*, 3*b*, the width b of the space between the electrodes 3*a*, 3*b*, the radius r of the developing roller 115; and the number m of portions of the electrodes 3*a*, 3*b* arranged in the axial center direction of the developing roller 115. Then, the control device adjusts the direction of the laser irradiator 13 properly so that the inclination of the outer edge of the spot S with respect to the longitudinal direction of the electrode bar 2 can be θ.

Figure 8:
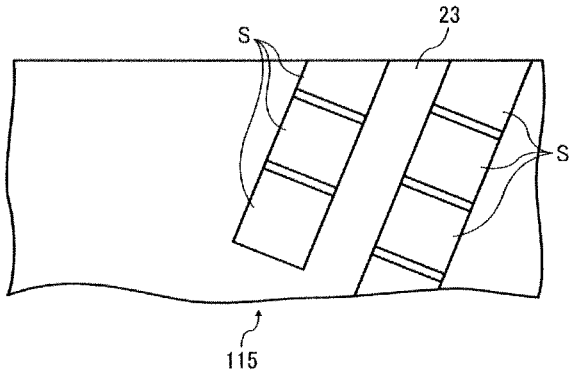
FIG. 8 is an explanatory view showing positions of spots of a laser beam of the surface machining apparatus shown in FIG. 7.
Figure 11:
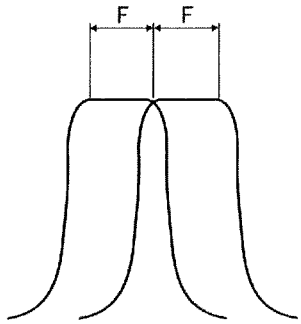
FIG. 11 is an explanatory view showing intensity distributions of a laser beam in the positions shown in FIG. 8.

After that, the control device causes the laser irradiator 13 to perform irradiation of the laser beam L for a certain fixed time long enough to remove the metal film 23 in the unnecessary portion, and then causes the motor 11 as the rotation drive unit to rotate the developing roller 115 about the axial center thereof while causing the movement actuator to move the laser irradiator 13 along the axial center (in the longitudinal direction) of the developing roller 115. Then, the control device causes the laser irradiator 13 to again perform irradiation of the laser beam L for the fixed time long enough to remove the metal film 23 of the unnecessary portion under the control such that portions F, shown in FIG. 10, having a substantially constant intensity in the spots S of the laser beam L can be arranged in the axial center direction of the developing roller 115 without having any gap in between as shown in FIG. 11, in other words, such that the spots S can partially overlap with each other in the axial center direction of the developing roller 115 as shown in FIG. 8.

The control device repeatedly causes the laser irradiator 13 to perform the irradiation of the laser beam L, the motor 11 to rotate the developing roller 115, and the movement actuator to move the laser irradiator 13, i.e., the laser beam L relative to the developing roller 115 in the axial center direction, in turn, as described above, and thereby removes the unnecessary portion from the foregoing metal film 23 to leave only the electrode bars 2 and the electrodes 3*a*, 3*b* on the outer surface of the base member 1.

Figure 12:
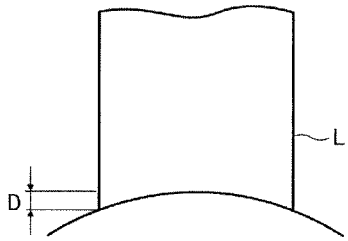
FIG. 12 is an explanatory view showing where a spot of a laser beam of the surface machining apparatus shown in FIG. 7 is located on the outer circumferential surface of the developing roller.
Figure 13:
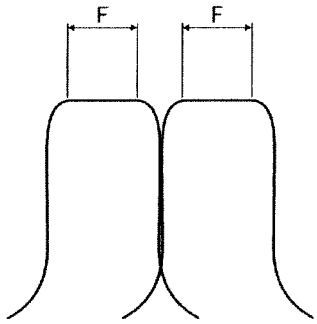
FIG. 13 is an explanatory view showing intensity distributions of a laser beam in positions leading to a machining failure.
Figure 14:
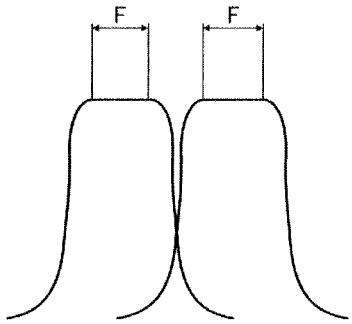
FIG. 14 is an explanatory view showing another example of intensity distributions of a laser beam in positions leading to a machining failure.
Figure 15:
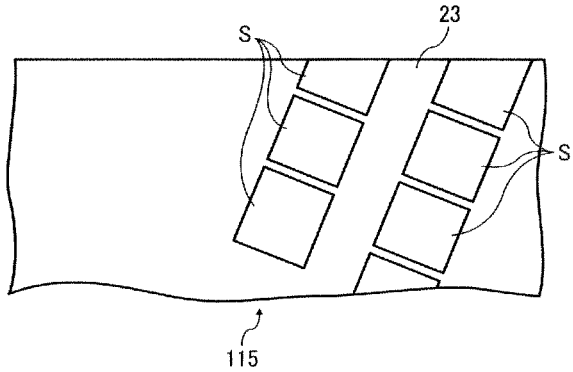
FIG. 15 is an explanatory view showing positions of spots of laser beams leading to a machining failure.

In this way, the metal film 23 is irradiated with the laser beam L with the outer edges of the rectangular spots S of the laser beam L inclined with respect to the axial center of the base member 1 in the developing roller 115, while the laser beam L is moved relative to the base member 1 in the axial center direction in conjunction with the rotation of the base member 1 about the axial center so that the spots S can partially overlap with each other in the axial center direction of the base member 1. At this time, the spots S are partially overlapped each other in the axial center direction of the base member 1 for the following reason. If the portions F having the substantially constant intensity in the spots S of the laser beam L are spaced out each other in the axial center direction of the developing roller 115 as shown in FIGS. 13 and 14, a deviation D between the focus position and the machining position of the laser beam L occurs at an edge portion of the spot S, as shown in FIG. 12, due to the curve of the outer surface of the developing roller 115. In this case, the unnecessary portion of the metal film 23 remains as shown in FIG. 15, and the remaining metal film 23 causes a short circuit between the adjacent electrodes 3*a*, 3*b*.

The developing device 113 having the foregoing configuration sufficiently agitates the toner particles T and the magnetic carriers in the developer supply unit 114, and causes the agitated developer to be adsorbed by the outer surface of the developing roller 115 by using the electrodes 3*a*, 3*b*. Then, with rotation of the developing roller 115, the developing device 113 conveys the toner particles T in the developer hopping between the electrodes 3*a*, 3*b* to the development region R. In this way, the developing device 113 carries the developer on the developing roller 115 to the development region R and forms the toner image by developing the electrostatic latent image on the photosensitive drum 108.

The developing device 113 removes and returns the developed developer to the developer supply unit 114. Then, the developed developer collected in the developer supply unit 114 is again sufficiently agitated with the other developer and is used for developing an electrostatic latent image on the photosensitive drum 108.

The image forming apparatus 101 having the foregoing configuration forms an image on the recording sheet 107 in the following way. Firstly, the image forming apparatus 101 rotates the photosensitive drums 108 and uniformly charges the outer surfaces of the photosensitive drums 108 at −700 V by using the charge rollers 109. With irradiation of a laser beam on the outer surface of each of the photosensitive drums 108, the photosensitive drum 108 is exposed to the beam to attenuate the voltage in an image portion to −150 V. Thereby, an electrostatic latent image is formed on the outer surface of the photosensitive drum 108. Then, when the electrostatic latent image is positioned in the development region R, a developing bias voltage of −550 V is applied to the electrostatic latent image. With this voltage application, the toner particles T in the developer hopping on the outer surface of the developing roller 115 of the developing device 113 are adsorbed by the outer surface of the photosensitive drum 108 to develop the electrostatic latent image. Thus, the toner image is formed on the outer surface of the photosensitive drum 108.

The image forming apparatus 101 locates the recording sheet 107, conveyed by the sheet feeder roller 124 in the sheet feeder unit 103 and other components, in positions between the photosensitive drums 108 of the process cartridges 106Y, 106M, 106C, 106K and the transfer unit 104 and transfers the toner images formed on the outer surfaces of the photosensitive drums 108 to the recording sheet 107. The image forming apparatus 101 fixes the toner images on the recording sheet 107 by using the fixation unit 105. In this way, the image forming apparatus 101 forms the color image on the recording sheet 107.

Meanwhile, the toner particles T remaining on the photosensitive drum 108 without being transferred are collected by the cleaning blade 112. The photosensitive drum 108 from which the residual toner particles are removed is initialized by an unillustrated discharge lamp and is used for the next image formation process.

In addition, the foregoing image forming apparatus 101 performs process control for preventing image variations due to an environmental change or a change over time. Specifically, the development performance of each of the developing devices 113 is detected. For example, an image of a certain toner pattern is formed on the photosensitive drum 108 under the condition with the development bias voltage kept constant, the image density is detected by an unillustrated optical sensor, and thereby the development performance is determined on the basis of the density variation. Then, the target value of the toner density is changed so that the development performance can be equal to a certain target development performance. Thus, the image quality can be kept constant. When the image density of the toner pattern detected by the optical sensor is lower than the target development density, for example, the CPU as unillustrated control means controls a motor drive circuit, for agitating the developer in the developer supply unit 114, so that the toner density can be increased. On the other hand, when the image density of the toner pattern detected by the optical sensor is higher than the target development density, the CPU controls the motor drive circuit so that the toner density can be lowered. Here, the toner density is detected by an unillustrated toner density sensor. Incidentally, the image density of the toner pattern formed on the photosensitive drum 108 may vary to a certain degree due to an influence of periodical image density unevenness caused by the developing roller 115.

In this embodiment, each of the electrodes 3*a*, 3*b* helically formed on the outer circumferential surface is formed to gradually taper down toward the outmost side thereof in the cross section. Thus, an area of each of the electrodes 3*a*, 3*b* in contact with the base member 1 can be increased. This makes the electrodes 3*a*, 3*b* less likely to peel off from the base member 1, and thereby can lead to improvement in the durability of the electrodes 3*a*, 3*b*.

In addition, in the developing roller 115, the pair of electrodes 3*a*, 3*b* are provided on the outer surface of the base member 1, and thereby surly cause the toner particles T to be hopping between the electrodes 3*a*, 3*b*. Thus, the developing roller 115 can surely perform the low voltage development.

Moreover, the electrodes 3*a*, 3*b* are manufactured by removing the unnecessary portion of the metal film 23 uniformly formed on the entire outer surface of the base member 1, with irradiation of the laser beam L as a high energy beam. The metal film 23 in the portions irradiated with the laser beam L can be surely removed. This makes it possible to obtain the electrodes 3*a*, 3*b* with high accuracy, i.e., to surely form the electrodes 3*a*, 3*b* exactly in the desired positions.

Moreover, the metal film 23 is irradiated with the laser beam L with the outer edges of the spots S of the laser beam L inclined with respect to the axial center of the base member 1, while the laser beam L is moved relative to the base member 1 in the axial center direction in conjunction with the rotation of the base member 1 about the axial center so that the spots S can partially overlap with each other in the axial center direction of the base member 1. With this machining, the helical electrodes 3*a*, 3*b* can be surely obtained and also the adjacent electrodes 3*a*, 3*b* can be prevented from being short-circuited.

Since the edge portions of the respective electrode bars 2 adjacent to each other are each formed in the saw-teeth shape, the electrode bars 2 also can be manufactured with the outer edges of the rectangular spots S of the laser beams L kept inclined. Thus, the time required to form the electrodes 3*a*, 3*b* can be reduced, which leads to cost reduction of the developing roller 115.

Since the base member 1 in the developing roller 115 is formed in a columnar shape, the developing roller 115 is usable as a so-called developing roller.

In addition, since the developing device 113 includes the above developing roller 115, the electrodes 3*a*, 3*b* therein can be made less likely to peel off from the base member 1 and thereby can have improved durability.

Furthermore, since the image forming apparatus 101 includes the above developing device 113, the electrodes 3*a*, 3*b* therein can be made less likely to peel off from the base member 1 and thereby can have improved durability.

Next, a developing roller 115 according to a second embodiment of the present invention will be described with reference to FIGS. 16 to 18. Here, the same units and portions as those in the foregoing first embodiment will be assigned the same reference numerals and the description thereof will be omitted.

Figure 16:
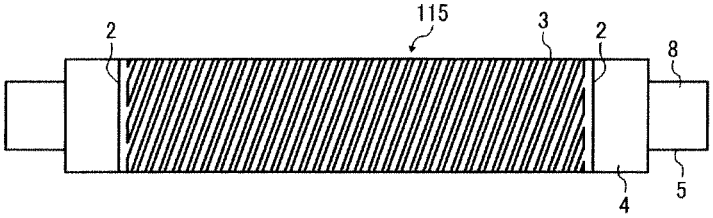
FIG. 16 is a side view of a developing roller according to a second embodiment of the present invention.
Figure 17:
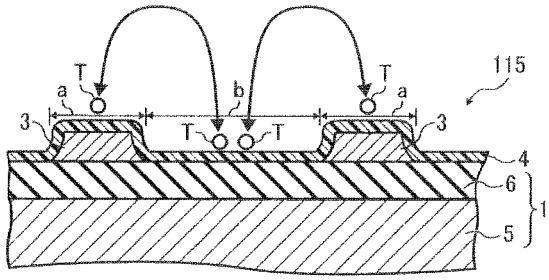
FIG. 17 is a cross sectional view of an essential portion of the developing roller shown in FIG. 16.
Figure 18:
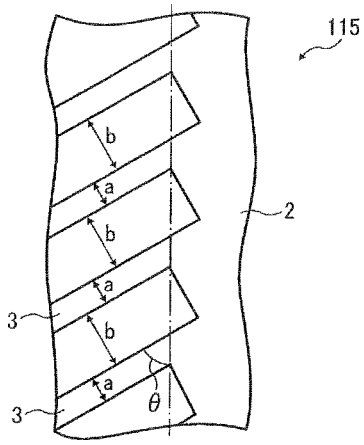
FIG. 18 is a planar view showing an enlarged view of an essential portion of the developing roller shown in FIG. 16.

In this embodiment, as shown in FIGS. 16 to 18, a developing roller 115 is provided with only a single electrode 3. This single electrode 3 is connected to both of paired electrode bars 2. The electrode 3 is ribbon-shaped and is formed between the electrode bars 2 on an outer surface of an insulating layer 6 of a base member 1. The electrode 3 is formed in a helical shape on the outer surface of the insulating layer 6 of the base member 1. Additionally, the electrode 3 is formed to have a cross section in which both sides of the electrode 3 are inclined so that the electrode 3 can gradually taper down from the base member 1 side toward the outmost side thereof, as shown in FIG. 17. Further, the electrode 3 is formed to be flat at a center portion in a width direction thereof so that the outer surface of the center portion can be in parallel with the outer surface of the insulating layer 6 of the base member 1 in its cross section, as shown in FIG. 17.

In the developing roller 115 having the foregoing configuration, an AV voltage is applied to the electrode 3 and a core 5 of the base member 1, and thereby the electrode 3 and the core 5 of the base member 1 form an alternating electric field in between. Thus, as shown in FIG. 17, the developing roller 115 causes toner particles T to be hopping so as to repeatedly reciprocate between the electrode 3 and the base member 1, i.e., the outer surface of the insulating layer 6, which are adjacent to each other. In this way, the developing roller 115 adsorbs the developer supplied from the developer supply unit 114, and causes the toner particles T to be hopping on the outer circumferential surface thereof. Then, by being driven to rotate about the axial center between the photosensitive drum 108 and the developer supply unit 114, the developing roller 115 develops the electrostatic latent image on the photosensitive drum 108 by causing the toner particles T hopping on the outer circumferential surface thereof to be adsorbed by the electrostatic latent image.

In addition, in this embodiment, the electrode 3 and the electrode bars 2 are formed by removing unnecessary portions of a metal film 23 by using the aforementioned surface machining apparatus 30 shown in FIG. 7, as in the case with the first embodiment.

In this embodiment, the electrode 3 helically formed on the outer circumferential surface is formed to gradually taper down toward the outmost side thereof in the cross section. Thus, an area of the electrode 3 in contact with the base member 1 can be increased. This makes the electrode 3 less likely to peel off from the base member 1, and thereby can lead to improvement in the durability of the electrode 3.

In addition, in the developing roller 115, the single electrode 3 is provided on the outer surface of the base member 1. The voltage is applied so that the alternating electric field can be formed between the electrode 3 and the core 5 of the base member 1, which surly causes the toner particles T to be hopping between the electrode 3 and a portion of the outer surface of the base member 1 that is located between each adjacent two portions of the electrode 3. Thus, the developing roller 115 can surely perform the low voltage development.

Figure 19:
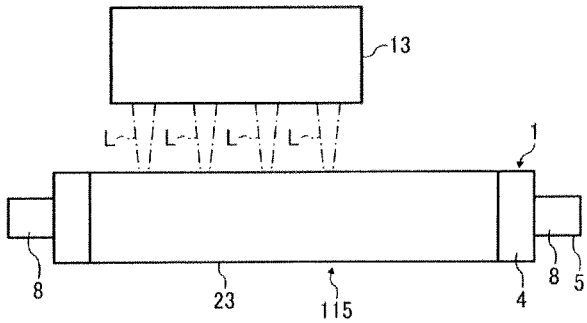
FIG. 19 is a side view of a schematic configuration of a modified example of the surface machining apparatus shown in FIG. 7.
Figure 20:
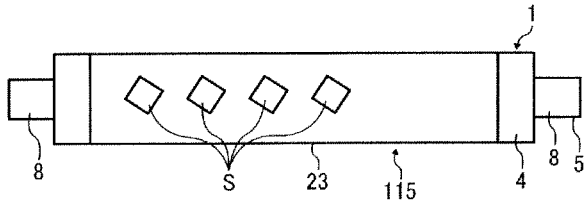
FIG. 20 is an explanatory view showing positions of spots of laser beams of the surface machining apparatus shown in FIG. 19.
Figure 21:
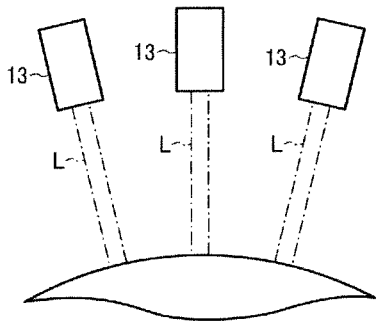
FIG. 21 is an explanatory view showing a schematic configuration of a surface machining apparatus as a comparative example.

In the present invention, the surface machining apparatus 30 may include multiple laser irradiators 13 as shown in FIG. 19. The laser irradiators 13 may be arranged in the axial center direction of the developing roller 115, and may perform irradiation of multiple laser beams L simultaneously to form the electrodes 3, 3*a*, 3*b*. In this case, with the simultaneous irradiation of the multiple laser beams L, the time required to form the electrodes 3, 3*a*, 3*b* can be reduced, whereby the cost reduction of the developing roller 115 can be achieved. Furthermore, in this case, it is not necessary to arrange the laser irradiators 13 in a circumferential direction as shown in FIG. 21, which allows simplification of the configuration of the surface machining apparatus 30. Here, in FIGS. 19 to 20, the same units and portions as those in the foregoing embodiments are assigned the same reference numerals and the description thereof is omitted.

Figure 22:
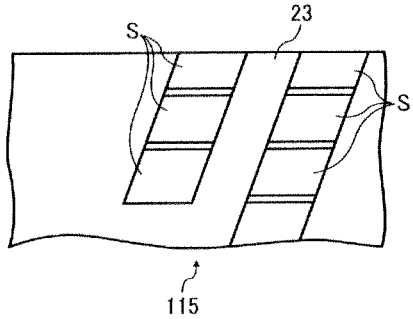
FIG. 22 is an explanatory view showing positions of spots of a laser beam in a modified example of the present invention.

Moreover, in the present invention, the beam shaping system of the laser irradiator 13 may shape the laser beam L so that the spot S can have a parallelogram shape as shown in FIG. 22.

Figure 23:
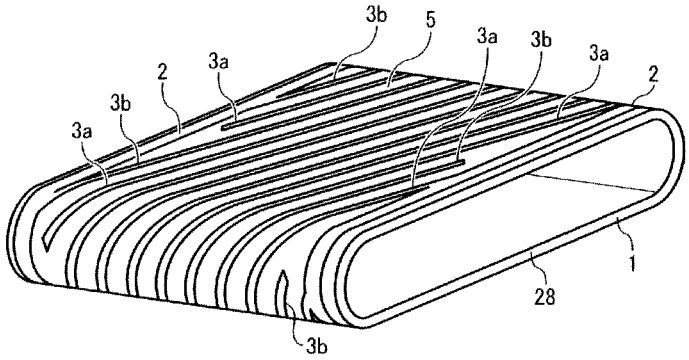
FIG. 23 is a perspective view showing an example of a developing belt as a toner carrier of the present invention.
Figure 24:
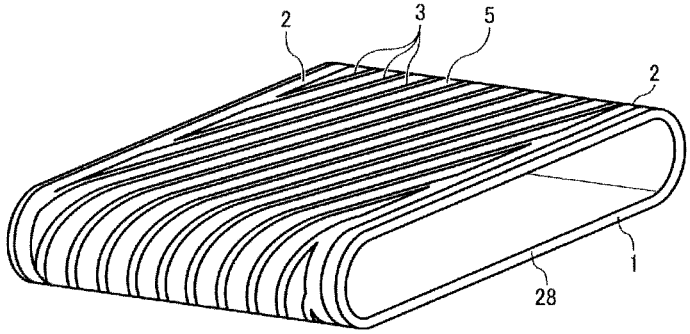
FIG. 24 is a perspective view showing another example of a developing belt as a toner carrier of the present invention.

Additionally, in the present invention, development belts 28 respectively shown in FIGS. 23 and 24 may be used as the toner carrier. A base member 1 of this development belt 28 is formed in an endless belt (endless annular) shape, as a matter of course. Here, in FIGS. 22 to 24, the same units and portions as those in the foregoing embodiments are assigned the same reference numerals and the description thereof is omitted.

Further, in the present invention, instead of the machining using the laser beam L, any of various kinds of machining, such as electric discharge machining, and machining using an electron beam, ion beam, or plasma as the high energy beam, for example, may be performed as long as the machining can sublimate and remove the unnecessary portion of the metal film 23.

Next, the inventors of the present invention fabricated the developing rollers 115 having the configurations described in the above embodiments.

Example 1

In Example 1, the core 5 was fabricated using an aluminum alloy with an outside diameter of the large-diameter portion 7 set to 20 mm, and then a polyimide precursor with a thickness of 5 μm was applied to the outer surface of the large-diameter portion 7. After that, the core 5 and the polyimide precursor were heated at 150 degrees for 30 minutes, and then were heated at 350 degrees for 60 minutes to form the insulating layer 6. The metal film 23 was formed by depositing a copper with a thickness of 1 μm on the entire outer surface of the insulating layer 6. The foregoing surface machining apparatus 30 irradiated the unnecessary potion of the metal film 23 with the laser beam L, and thereby the electrode bars 2 and the electrodes 3*a*, 3*b* were formed.

In Example 1, a YAG laser with a wavelength of 1064 nm was used and a kaleidoscope including four mirrors combined together in a rectangular shape with their mirror surfaces facing inside was used. With use of this kaleidoscope, the laser beam L was shaped to have an intensity distribution in a shape as shown in FIG. 10. In the machining, of course, the laser irradiator 13 including the above kaleidoscope was moved relative to the developing roller 115 in the axial center direction and the developing roller 115 was rotated at the same time.

Additionally, in the machining of Example 1, a portion of the metal film 23 with a width of approximately 300 μm was removed with the spot S on the outer surface of the developing roller 115 set to be in a square of 300 μm on each side. In addition, the laser irradiator 13 was set to have a laser oscillation frequency of 1 kHz and an output power of 10 W, and performed irradiation of the laser beam L every time the laser irradiator 13 was relatively moved by 250 μm. In Example 1, a speed in the axial center direction was set to 160 mm/s and the number of revolutions of the developing roller 115 was set to 185 rpm. With these settings, 53 seconds were needed for the machining time per developing roller 115.

In the above way, the two electrode bars 2 and 80 portions of the electrodes 3*a*, 3*b* arranged at intervals in the axial center direction in the foregoing embodiment were formed. Since the electrodes 3*a*, 3*b* was set to have a width a of 200 μm and have a space with a width b of 300 μm in between, the aforementioned inclination θ of the spot S in the machining were calculated to be 39.5 degrees from Formula 1 described above. Moreover, since the machining was performed with the spots S inclined, the edge portions of the respective electrode bars 2 adjacent to each other were each formed in a saw-teeth shape. The machining was performed with the spots S partially overlapping with each other in the axial center direction, and consequently the trail of the spots S was formed on the insulating layer 6. If the electrodes 3*a*, 3*b* are formed in parallel with the axial center direction, 126 portions of the electrodes 3*a*, 3*b* are needed. In contrast, in the first embodiment, a necessary number of portions of the electrodes 3*a*, 3*b* can be reduced to approximately ⅔. For this reason, it is obvious that the machining time can be made shorter than the time for manufacturing the conventional developing roller described in aforementioned Patent Document 1. After that, a silicone resin with a thickness of 5 μm was applied to the resultant surface to form the aforementioned protection layer 4.

In formation of an image on a recording sheet 107 by use of the developing roller 115 in Example 1, an AV voltage is applied to the electrodes 3*a*, 3*b*, and thereby the electrodes 3*a*, 3*b* form an alternating electric field in between. A toner particle T placed above the electrode 3*a* of the electrodes 3*a*, 3*b* floats up and lands on the other electrode 3*b*, and then again floats up from the other electrode 3*b* and lands on the electrode 3*a*. While repeating such hopping, the toner particles T are conveyed to the development region R with a surface movement of the developing roller 115 along with its rotation. In the development region R, the toner particles T float up to the proximity of an electrostatic latent image on the photosensitive drum 108, and are adsorbed by the latent image, without falling down to the electrodes 3*a*, 3*b* of the developing roller 115, with attraction of the electric field produced by the latent image. With this configuration, instead of toner particles T adhering to the developing roller 115 or magnetic carriers, toner particles T not exerting the adsorptive power due to the hopping were able to be used for development.

Example 2

In Example 2, the core 5 was fabricated using an aluminum alloy with an outside diameter of the large-diameter portion 7 set to 16 mm, and then $SiO^2$ was deposited with a thickness of 0.5 μm on the outer surface of the large-diameter portion 7 to form the insulating layer 6. The metal film 23 was formed by depositing an aluminum alloy with a thickness of 1 μm on the entire outer surface of the insulating layer 6. The foregoing surface machining apparatus 30 irradiated the unnecessary potion of the metal film 23 with the laser beam L, and thereby the electrode bars 2 and the electrodes 3*a*, 3*b* were formed.

In Example 2, the laser beam L was shaped to have an intensity distribution in a shape as shown in FIG. 10 by using a YAG laser with a wavelength of 1064 nm and a top hat homogenizer. In the machining, of course, the laser irradiator 13 was moved relative to the developing roller 115 in the axial center direction and the developing roller 115 was rotated at the same time.

Additionally, in the machining of Example 2, a portion of the metal film 23 with a width of approximately 100 μm was removed with the spot S on the outer surface of the developing roller 115 set to be in a rectangular shape of 100 μm×200 μm. In addition, the laser irradiator 13 was set to have a laser oscillation frequency of 2 kHz and an output power of 7 W, and performed irradiation of the laser beam L every time the laser irradiator 13 was relatively moved by 180 μm. In Example 2, a speed in the axial center direction was set to 260 mm/s and the number of revolutions of the developing roller 115 was set to 300 rpm. With these settings, 190 seconds were needed for the machining time per developing roller 115.

In the above way, the two electrode bars 2 and 180 portions of the electrodes 3*a*, 3*b* arranged at intervals in the axial center direction in the foregoing embodiment were formed. Since the electrodes 3*a*, 3*b* were set to have a width a of 100 μm and have a space with a width b of 100 μm in between, the aforementioned inclination θ of the spot S in the machining were calculated to be 45.7 degrees from Formula 1 described above. Moreover, since the machining was performed with the spots S inclined, the edge portions of the respective electrode bars 2 adjacent to each other were each formed in a saw-teeth shape. The machining was performed with the spots S partially overlapping with each other in the axial center direction, and consequently the trail of the spots S was formed on the insulating layer 6. After that, $SiO^2$ was deposited with a thickness of 0.5 μm on the resultant surface to form the protection layer 4.

In formation of an image on a recording sheet 107 by use of the developing roller 115 in Example 2, an AV voltage is applied to the electrodes 3*a*, 3*b*, and thereby the electrodes 3*a*, 3*b* form an alternating electric field in between. A toner particle T placed above the electrode 3*a* of the electrodes 3*a*, 3*b* floats up and lands on the other electrode 3*b*, and then again floats up from the other electrode 3*b* and lands on the electrode 3*a*. While repeating such hopping, the toner particles T are conveyed to the development region R with a surface movement of the developing roller 115 along with its rotation. In the development region R, the toner particles T float up to the proximity of an electrostatic latent image on the photosensitive drum 108, and are adsorbed by the latent image, without falling down to the electrodes 3*a*, 3*b* of the developing roller 115, with attraction of the electric field produced by the latent image. With this configuration, instead of toner particles T adhering to the developing roller 115 or magnetic carriers, toner particles T not exerting the adsorptive power due to the hopping were able to be used for development. In addition, in Example 2, since the aluminum alloy has a higher absorbance than the copper, the laser beam L was able to be set to have a lower output power than that in above-mentioned Example 1.

Example 3

In Example 3, the core 5 was fabricated using an aluminum alloy with an outside diameter of the large-diameter portion 7 set to 10 mm, and then a polyimide precursor with a thickness of 3 μm was applied to the outer surface of the large-diameter portion 7. After that, the core 5 and the polyimide precursor were heated at 150 degrees for 30 minutes, and then were heated at 350 degrees for 60 minutes to form the insulating layer 6. The metal film 23 was formed by depositing a copper with a thickness of 1 μm on the entire outer surface of the insulating layer 6. The foregoing surface machining apparatus 30 irradiated the unnecessary potion of the metal film 23 with the laser beam L, and thereby the electrode bars 2 and the electrode 3 were formed.

In Example 3, the laser beam L was shaped to have an intensity distribution in a shape as shown in FIG. 10 by using a YAG laser with a wavelength of 1064 nm and a top hat homogenizer. In the machining, of course, the laser irradiator 13 was moved relative to the developing roller 115 in the axial center direction and the developing roller 115 was rotated at the same time.

Additionally, in the machining of Example 3, a portion of the metal film 23 with a width of approximately 150 μm was removed with the spot S on the outer surface of the developing roller 115 set to be in a rectangular shape of 150 μm×300 μm. In addition, the laser irradiator 13 was set to have a laser oscillation frequency of 3 kHz and an output power of 9 W, and performed irradiation of the laser beam L every time the laser irradiator 13 was relatively moved by 250 μm. In Example 3, a speed in the axial center direction was set to 240 mm/s and the number of revolutions of the developing roller 115 was set to 1360 rpm. With these settings, 40 seconds were needed for the machining time per developing roller 115.

In the above way, the two electrode bars 2 and 40 portions of the electrode 3 arranged at intervals in the axial center direction in the foregoing embodiment were formed. Since the portions of the electrode 3 were set to have a width a of 100 μm and have a space with a width b of 100 μm in between, the aforementioned inclination θ of the spot S in the machining was calculated to be 18.5 degrees from Formula 1 described above. Moreover, since the machining was performed with the spots S inclined, the edge portions of the respective electrode bars 2 adjacent to each other were each formed in a saw-teeth shape. The machining was performed with the spots S partially overlapping with each other in the axial center direction, and consequently the trail of the spots S was formed on the insulating layer 6. After that, a silicone resin with a thickness of 0.8 μm was applied to the resultant surface to form the aforementioned protection layer 4.

In formation of an image on a recording sheet 107 by use of the developing roller 115 in Example 3, an AV voltage is applied to the electrode 3 and the core 5, and thereby an alternating electric field is formed therebetween. A toner particle T placed above the electrode 3 floats up and lands on the outer surface of the insulating layer 6, and then again floats up from the outer surface of the insulating layer 6 and lands on the electrode 3. While repeating such hopping, the toner particles T are conveyed to the development region R with a surface movement of the developing roller 115 along with its rotation. In the development region R, the toner particles T float up to the proximity of an electrostatic latent image on the photosensitive drum 108, and are adsorbed by the latent image, without falling down to the electrode 3 of the developing roller 115, with attraction of the electric field produced by the latent image. With this configuration, instead of toner particles T adhering to the developing roller 115 or magnetic carriers, toner particles T not exerting the adsorptive power due to the hopping were able to be used for development.

Example 4

In Example 4, the core 5 was fabricated using an aluminum alloy with an outside diameter of the large-diameter portion 7 set to 16 mm, and then $SiO^2$ was deposited with a thickness of 0.5 μm on the outer surface of the large-diameter portion 7 to form the insulating layer 6. The metal film 23 was formed by depositing an aluminum alloy with a thickness of 1 μm on the entire outer surface of the insulating layer 6. The foregoing surface machining apparatus 30 irradiated the unnecessary potion of the metal film 23 with the laser beam L, and thereby the electrode bars 2 and the electrodes 3*a*, 3*b* were formed.

In Example 4, the laser beam L was shaped to have an intensity distribution in a shape as shown in FIG. 10 by using a YAG laser with a wavelength of 1064 nm and a top hat homogenizer. In the machining, of course, the laser irradiator 13 was moved relative to the developing roller 115 in the axial center direction and the developing roller 115 was rotated at the same time. In addition, in Example 4, the spot S of the beam was formed in a parallelogram shape by using a mask made of a metal.

Additionally, in the machining of Example 4, a portion of the metal film 23 with a width of approximately 100 μm was removed with the spot S on the outer surface of the developing roller 115 set to be in a parallelogram shape having an interval between two sides of 100 μm and a height of 200 μm. In addition, the laser irradiator 13 was set to have a laser oscillation frequency of 2 kHz and an output power of 7 W, and performed irradiation of the laser beam L every time the laser irradiator 13 was relatively moved by 180 μm. In Example 4, a speed in the axial center direction was set to 260 mm/s and the number of revolutions of the developing roller 115 was set to 300 rpm. With these settings, 190 seconds were needed for the machining time per developing roller 115.

In the above way, the two electrode bars 2 and 180 electrodes 3*a*, 3*b* arranged at intervals in the axial center direction in the foregoing embodiment were formed. Since the electrodes 3*a*, 3*b* were set to have a width a of 100 μm and have a space with a width b of 100 μm in between, the aforementioned inclination θ of the spot S in the machining was calculated to be 45.7 degrees from Formula 1 described above. Moreover, since the machining was performed with the spots S inclined, the edge portions of the respective electrode bars 2 adjacent to each other were each formed in a saw-teeth shape. The machining was performed with the spots S partially overlapped each other in the axial center direction, and consequently the trail of the spots S was formed on the insulating layer 6. After that, $SiO^2$ was deposited with a thickness of 0.5 μm on the resultant surface to form the protection layer 4.

In formation of an image on a recording sheet 107 by use of the developing roller 115 in Example 4, an AV voltage is applied to the electrodes 3*a*, 3*b*, and thereby the electrodes 3*a*, 3*b* form an alternating electric field in between. A toner particle T placed above the electrode 3*a* of the electrodes 3*a*, 3*b* floats up and lands on the other electrode 3*b*, and then again floats up from the other electrode 3*b* and lands on the electrode 3*a*. While repeating such hopping, the toner particles T are conveyed to the development region R with a surface movement of the developing roller 115 along with its rotation. In the development region R, the toner particles T float up to the proximity of an electrostatic latent image on the photosensitive drum 108, and are adsorbed by the latent image, without falling down to the electrodes 3*a*, 3*b* of the developing roller 115, with attraction of the electric field produced by the latent image. With this configuration, instead of toner particles T adhering to the developing roller 115 or magnetic carriers, toner particles T not exerting the adsorptive power due to the hopping were able to be used for development. In addition, in Example 4, since the aluminum alloy has a higher absorbance than the copper, the laser beam L was able to be set to have a lower output power than that in above-mentioned Example 1.

In the aforementioned image forming apparatus 101, each of the process cartridges 106Y, 106M, 106C, 106K includes the cartridge case 111, the charge roller 109, the photosensitive drum 108, the cleaning blade 112 and the developing device 113. In the present invention, however, each of the process cartridges 106Y, 106M, 106C, 106K may include only at least the developing device 113, and may not necessarily include the cartridge case 111, the charge roller 109, the photosensitive drum 108, or the cleaning blade 112. Meanwhile, in the foregoing embodiments, the image forming apparatus 101 includes the process cartridges 106Y, 106M, 106C, 106K detachably attachable to the apparatus main body 102. In the present invention, however, the image forming apparatus 101 may include only at least the developing device 113, and may not necessarily include the process cartridges 106Y, 106M, 106C, 106K.

According to the present invention, each ribbon-shaped electrode helically formed on the outer circumferential surface is formed to gradually taper down toward the outmost side thereof in the cross section. Thus, an area of the electrode in contact with the base member can be increased. This makes the electrode less likely to peel off from the base member, and thereby can lead to improvement in the durability of the electrode.

A toner carrier is provided with a pair of electrodes on the outer surface of a base member, and thereby is capable of surly causing toner particles to be hopping between the electrodes. Thus, the toner carrier can surely perform the low voltage development.

A toner carrier is provided with a single electrode on an outer surface of a base member. The voltage is applied so that the alternating electric field can be formed between the electrode and a core of the base member, which surly causes the toner particles T to be hopping between the electrode and a portion of the outer surface of the base member that is located between each adjacent two portions of the electrode. Thus, the toner carrier can surely perform the low voltage development.

The electrodes are manufactured by removing the unnecessary portion of the metal film uniformly formed on the entire outer surface of the base member, with irradiation of the high energy beam. The metal film in the portions irradiated with this beam can be surely removed. This makes it possible to obtain the electrodes with high accuracy, i.e., to surely form the electrodes exactly in the desired positions.

The metal film is irradiated with the laser beam with the outer edges of the spots of the beam inclined with respect to the axial center of the base member, while the beam is moved relative to the base member in the axial center direction in conjunction with the rotation of the base member about the axial center so that the spots S can partially overlap with each other in the axial center direction of the base member. With this machining, the helical electrodes can be surely obtained and also the adjacent electrodes can be prevented from being short-circuited.

With the simultaneous irradiation of multiple beams, a time required to form the electrodes can be reduced, whereby the cost reduction of the toner carrier can be achieved.

Since the edge portions of the respective electrode bars adjacent to each other are each formed in a saw-teeth shape, the electrode bars also can be manufactured with the outer edge of the rectangular spot of the beam kept inclined. Thus, the time required to form the electrodes can be reduced, which leads to achievement of cost reduction of the toner carrier.

Since the base member is formed in a columnar shape, the toner carrier is usable as a so-called developing roller.

The base member is formed in an endless belt shape and thereby is usable a so-called developing belt.

Since a developing device according to the present invention includes the foregoing toner carrier, the electrodes therein can be made less likely to peel off from the base member and thereby can have improved durability.

In addition, since an image forming apparatus according to the present invention includes the above developing device, the electrodes therein can be made less likely to peel off from the base member and thereby can have improved durability.

It should be noted that the present invention is not limited to the aforementioned embodiments. In other words, the present invention is implementable with various modifications and changes without departing from the gist of the invention.

What is claimed is:

1. A toner carrier that conveys toner particles hopping on an outer circumferential surface of the toner carrier to a development region facing a latent image carrier, the toner carrier comprising:

a base member including at least an insulating layer made of an insulator in an outer surface of the base member; and at least one electrode in a ribbon shape helically formed on the outer surface of the base member, wherein the electrode is formed to have a cross section in which both sides of the electrode are inclined so that the electrode gradually tapers down from the base member toward an outmost side thereof, and is formed to be flat in a center portion in a width direction of the electrode so that an outer surface of the center portion is in parallel with the outer surface of the base member, wherein the electrode is provided as only a single electrode, and a voltage is applied to the electrode and a conductive core of the base member so that an alternating electric field is formed between the electrode and the core.

2. The toner carrier according to claim 1, wherein the electrode is formed in a way that an unnecessary portion of a metal film uniformly formed on the entire outer surface of the base member is removed by irradiating the metal film with a high energy beam.

3. The toner carrier according to claim 2, wherein as the beam, a plurality of beams are radiated simultaneously to form the electrode.

4. The toner carrier according to claim 1, wherein the base member is formed in a columnar shape.

5. The toner carrier according to claim 1, wherein the base member is formed in an endless belt shape.

6. A developing device including a toner carrier that conveys toner particles hopping on an outer circumferential surface of the toner carrier to a development region facing a latent image carrier, the developing device comprising the toner carrier according to claim 1.

7. An image forming apparatus at least including a latent image carrier, a charge device, and a developing device, the image forming apparatus comprising the developing device according to claim 6.

8. A toner carrier that conveys toner particles hopping on an outer circumferential surface of the toner carrier to a development region facing a latent image carrier, the toner carrier comprising:

a base member including at least an insulating layer made of an insulator in an outer surface of the base member; and at least one electrode in a ribbon shape helically formed on the outer surface of the base member, wherein the electrode is formed to have a cross section in which both sides of the electrode are inclined so that the electrode gradually tapers down from the base member toward an outmost side thereof and is formed to be flat in a center portion in a width direction of the electrode so that an outer surface of the center portion is in parallel with the outer surface of the base member, wherein the electrode is formed in a way that an unnecessary portion of a metal film uniformly formed on the entire outer surface of the base member is removed by irradiating the metal film with a high energy beam, and wherein the metal film is irradiated with the beam with outer edges of rectangular spots of the beam inclined with respect to an axial center of the base member, while the beam is moved relative to the base member in an axial center direction of the base member in conjunction with a rotation of the base member about the axial center so that the spots partially overlap with each other in the axial center direction of the base member.

9. The toner carrier according to claim 8, wherein as the beam, a plurality of beams are radiated simultaneously to form the electrode.

10. A toner carrier that conveys toner particles hopping on an outer circumferential surface of the toner carrier to a development region facing a latent imaging carrier, the toner carrier comprising:

a base member including at least an insulating layer made of an insulator in an outer surface of the base member; and at least one electrode in a ribbon shape helically formed on the outer surface of the base member, wherein the electrode is formed to have a cross section in which both sides of the electrode are inclined so that the electrode gradually tapers down from the base member toward an outmost side thereof and is formed to be flat in a center portion in a width direction of the electrode so that an outer surface of the center portion is in parallel with the outer surface of the base member, wherein the electrode is formed in a way that an unnecessary portion of a metal film uniformly formed on the entire outer surface of the base member is removed by irradiating the metal film with a high energy beam, and wherein electrode bars connected to the electrode are provided on both respective end portions of the outer surface of the base member in the axial center direction, the electrode bars each extending in a direction orthogonal to the axial center, and edge portions of the respective electrode bards that are adjacent to each other are each formed in a saw-teeth shape.

* * * * *